US007422452B2

(12) United States Patent
Achtner et al.

(10) Patent No.: US 7,422,452 B2
(45) Date of Patent: Sep. 9, 2008

(54) POWER PLUG ADAPTER

(75) Inventors: Richard Mark Achtner, Bradenton, FL (US); Jeffery J. Gadamus, Hortonville, WI (US)

(73) Assignee: Illinois Tool Works Inc., Glenview, IL (US)

( * ) Notice: Subject to any disclaimer, the term of this patent is extended or adjusted under 35 U.S.C. 154(b) by 38 days.

(21) Appl. No.: 11/276,298

(22) Filed: Feb. 23, 2006

(65) Prior Publication Data

US 2006/0134991 A1 Jun. 22, 2006

Related U.S. Application Data

(62) Division of application No. 10/904,936, filed on Dec. 6, 2004, now Pat. No. 7,040,931.

(51) Int. Cl.
*H01R 13/66* (2006.01)

(52) U.S. Cl. ..... 439/106; 439/502; 439/357

(58) Field of Classification Search ..... 439/106, 439/502, 357, 651, 103, 105, 173, 171, 174
See application file for complete search history.

(56) References Cited

U.S. PATENT DOCUMENTS

| | | | | |
|---|---|---|---|---|
| 1,275,693 | A | 9/1918 | Hubbell | |
| 1,874,828 | A | 8/1932 | Suss | |
| 2,417,928 | A | 3/1947 | Guernsey | |
| 2,450,657 | A | 10/1948 | Guernsey | |
| 2,988,617 | A | 6/1961 | Graziosi | |
| 2,989,719 | A | 8/1961 | Aariaht | |
| 3,025,486 | A | 3/1962 | Falconer | |
| 3,268,847 | A * | 8/1966 | Klumpp, Jr. | 439/105 |
| 3,382,475 | A | 5/1968 | Kramer | |
| 3,739,317 | A | 6/1973 | Wise | |
| 3,996,546 | A | 12/1976 | Hugly | |
| 4,131,805 | A | 12/1978 | Austin et al. | |
| 4,273,409 | A | 6/1981 | Blanche et al. | |
| 4,494,809 | A | 1/1985 | Soloman | |
| 4,579,410 | A | 4/1986 | Soloman | |
| 4,815,983 | A | 3/1989 | Erickson et al. | |
| 4,856,999 | A | 8/1989 | Flohr | |
| 4,911,649 | A | 3/1990 | Helmich, Jr. | |
| 4,997,381 | A | 3/1991 | Oh | |
| 5,319,533 | A | 6/1994 | Reynolds et al. | |
| 5,409,397 | A | 4/1995 | Karman | |
| 5,446,641 | A | 8/1995 | Reynolds et al. | |
| 5,540,596 | A | 7/1996 | Bothe et al. | |
| 5,601,741 | A | 2/1997 | Thommes | |
| 5,684,689 | A | 11/1997 | Hahn | |
| 6,002,103 | A | 12/1999 | Thommes | |
| 6,227,883 | B1 | 5/2001 | Lee et al. | |
| 6,247,941 | B1 | 6/2001 | Lee et al. | |
| 6,287,131 | B1 | 9/2001 | Deng | |

(Continued)

*Primary Examiner*—Gary F. Paumen
(74) *Attorney, Agent, or Firm*—Ziolkowski Patent Solutions Group, SC

(57) ABSTRACT

An adapter for connecting a welding-type power source to various different input voltage signals is disclosed. The adapter comprises a body with a receptacle at one end which is connectable to a power cord of a welding-type power source and a plug at another end which is connectable with a number of different electrical outlet configurations. The body of the adapter is shaped to allow both the plug and a grounding prong of a connected power cord to engage the same outlet.

22 Claims, 3 Drawing Sheets

U.S. PATENT DOCUMENTS 6,328,581 B1 12/2001 Lee et al.
6,383,003 B1 * 5/2002 Corona ..... 439/278
6,454,576 B1 9/2002 Hedrick et al.
6,710,254 B2 * 3/2004 Yueh ..... 174/135
6,720,527 B2 4/2004 Gadamus et al.
6,802,741 B1 * 10/2004 Shatkin ..... 439/620
6,863,555 B2 3/2005 Ito

* cited by examiner

POWER PLUG ADAPTER

CROSS-REFERENCE TO RELATED APPLICATION

The present application is a divisional and claims priority to allowed U.S. patent application Ser. No. 10/904,936 filed on Dec. 6, 2004 and entitled "Power Plug Adapter."

BACKGROUND OF THE INVENTION

The present invention relates generally to welding, and more particularly, to power cords for welding-type power sources. The present invention includes a power cord and adapter assembly capable of providing a plurality of different input voltage signals to a welding-type power source.

Standard input voltage signals provided by power utilities usually have approximate voltage values of 110/115V, 200/208V, 230/240V, 380/415V, 460/480V, 500V, or 575V. The actual line input voltage signals available at particular locations vary, and the voltage signals could be either single-phase or three-phase, could have different current ratings, and could be 50 or 60 Hz power signals. However, these values are merely exemplary and are not intended to limit the invention, only to provide actual values for ease of understanding. Additionally, whenever two input power signals are hereinafter described as "different" from each other, it is implied that at least one of the electrical parameters described above is not the same between the two signals.

Some welding-type power sources are able to convert several different line input voltage signals into power signals suitable for welding-type applications. For example, such a power source could receive one of several different input voltage signals and internally convert it to a different voltage AC signal or a different voltage DC signal to provide a welding-type power signal. The different high voltage AC input signals usable by such a power source are typically a subset of various line input voltage signals provided by a power utility. Some of these power sources require an operator to perform a manual adjustment to the power source to accommodate a particular input voltage signal, while other power sources can automatically sense and adjust to particular input voltage signals.

However, some drawbacks arise due to the fact that different standardized electrical interface configurations, wall outlets, and/or plug and socket configurations are employed for each standard input voltage signal. Thus, a power source must be able to interface with multiple standardized electrical interface configurations or the usefulness of converting various types of input voltage signals into welding-type output is reduced. For example, if a welding-type power source was capable of converting both a 60 Hz signal-phase 115 volt line input signal rated at 20 amps and a 60 Hz single-phase 230 volt line input signal rated at 20 amps, an operator would be required to change the power cord in order to allow connectivity of the welding-type device with multiple outlets having different plug and socket configurations or have some form of adapter.

Alternatively, connecting a power source to various standardized electrical interfaces could be achieved by cutting off the plug end of the power cord of a power source and replacing it with a new plug that is properly configured to receive a different line input voltage signal. Regardless of whether the entire cord is replaced or whether the plug is physically severed from the cord, such methods are time consuming, wasteful, and impractical. Additionally, such practices also present an undesirable opportunity for the operator to improperly connect the welding-type device to the electrical supply. That is, an operator may inadvertently connect the leads of the power cord to the wrong terminals of the welding-type device or the wrong prongs of the associated plug, respectively. Misuse of the plug or cord could result in improper operation of the welding-type device or damage to the electrical components thereof.

Other known methods for connecting power cords to various outlet configurations utilize adapters or power cord ends which have removable, repositionable, or interchangeable plug prongs. Notwithstanding the fact that such systems are not necessarily configured for use with welding-type systems, they are nonetheless undesirable for such applications. A power cord adapter or power cord end with removable plug prongs creates risks that prongs may be lost, damaged, corroded, or made otherwise unusable. In general, adapters and power cord ends using removable, repositionable, or interchangeable plug prongs do not ensure the same expectations of durability derived from similar, fixed-prong adapters and power cord ends.

Thus, although some welding-type power sources have the capability to convert one of a plurality of different input voltage signals into a welding-type output signal, such power sources must also be physically manipulated to connect to multiple electrical interface configurations. Several known methods of changing the plug orientation of the welding-type device are time-consuming to implement, add to the number of required parts, and increase the overall complexity of a welding-type device. It would therefore be desirable to have a power cord that is capable of quickly and conveniently providing a plurality of different input power signals to a welding-type power source. Furthermore, such a system should be efficiently connectable and removable, and able to receive various different line input voltage signals without the need for modifications to the power cord or power plug.

BRIEF DESCRIPTION OF THE INVENTION

The present invention provides an adapter useable in a system and method for connecting a welding-type power source to various standard electrical outlets having different interfaces therebetween that overcomes the aforementioned drawbacks. Specifically, the invention includes an adapter capable of connecting to more than one electrical interface configuration. The adapter connects to a power cord having one end that is attached to a welding-type power source and another end that is connectable with the adapter in a plurality of positions. The adapter is connectable to the power cord and a number of different electrical outlet configurations.

In accordance with one aspect of the present invention, an adapter is provided having an electrical outlet mating surface, a body having a distal end and a proximate end, a pair of electrical sockets at the distal end of the body, and a pair of flanges extending outwardly from the electrical outlet mating surface. The electrical outlet mating surface has a pair of electrical prongs extending outwardly therefrom. The body extends rearwardly from the electrical outlet mating surface and parallel to the electrical prongs. Each electrical socket at the distal end of the body is in electrical communication with a respective electrical prong of the electrical outlet mating surface. Each flange extends perpendicular to the electrical prongs and has an opening therein sized to allow passage of an electrical grounding prong therethrough.

In accordance with another aspect of the invention, an adapter for a power cord of a welding-type power source is provided. The adapter has a body having a first end and a second end. The first end is electrically connectable to a power cord connectable to a welding-type device. The second end has a pair of prongs fixedly attached to the body and constructed to operably connect the power cord to a first outlet and a second outlet, the second outlet being configured differently than the first outlet.

In accordance with another aspect of the invention, an adapter is provided for connecting a power cord to a plurality of outlet configurations. The adapter includes a body having a plug and a receptacle. The receptacle is constructed to removably engage a power cord, and the plug is constructed to be connectable with a first electrical outlet configuration and a second electrical outlet configuration different than the first electrical outlet configuration. The body is constructed to allow a prong of the power cord to engage one of the first and second electrical outlet configurations with the body positioned therebetween.

In accordance with another aspect of the present invention, a power cord for a welding-type device is provided. The power cord has one end connectable to a power source of a welding-type device and another end connectable to an adapter. The adapter has a pair of immovable prongs which are connectable to a first input voltage signal and a second input voltage signal wherein the first input voltage signal has a power characteristic different than a power characteristic of the first input voltage signal.

In accordance with yet another aspect of the present invention, a welding-type apparatus is provided, having a power source, a power cord, and an adapter. The power source is configured to generate a welding-type power. The power cord has a first end connectable with the power source and a second end. The second end of the power cord has an adapter interface and an electrical contact configured to engage electrical outlets. The adapter is configured to engage a number of different electrical outlet configurations.

In accordance with a further aspect of the present invention, a method is disclosed for providing a power cord and adapter useable with multiple electrical interface configurations. The method includes the steps of forming an adapter interface on a power cord having a pair of power prongs extending therefrom and a grounding prong extending significantly past the pair of power prongs, and molding an adapter to couple to the adapter interface of the power cord and having a pair of openings which allow the grounding prong to pass through one of the openings when the adapter is engaged with the power cord in one orientation and through another of the openings when in another orientation.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

Figure 1:
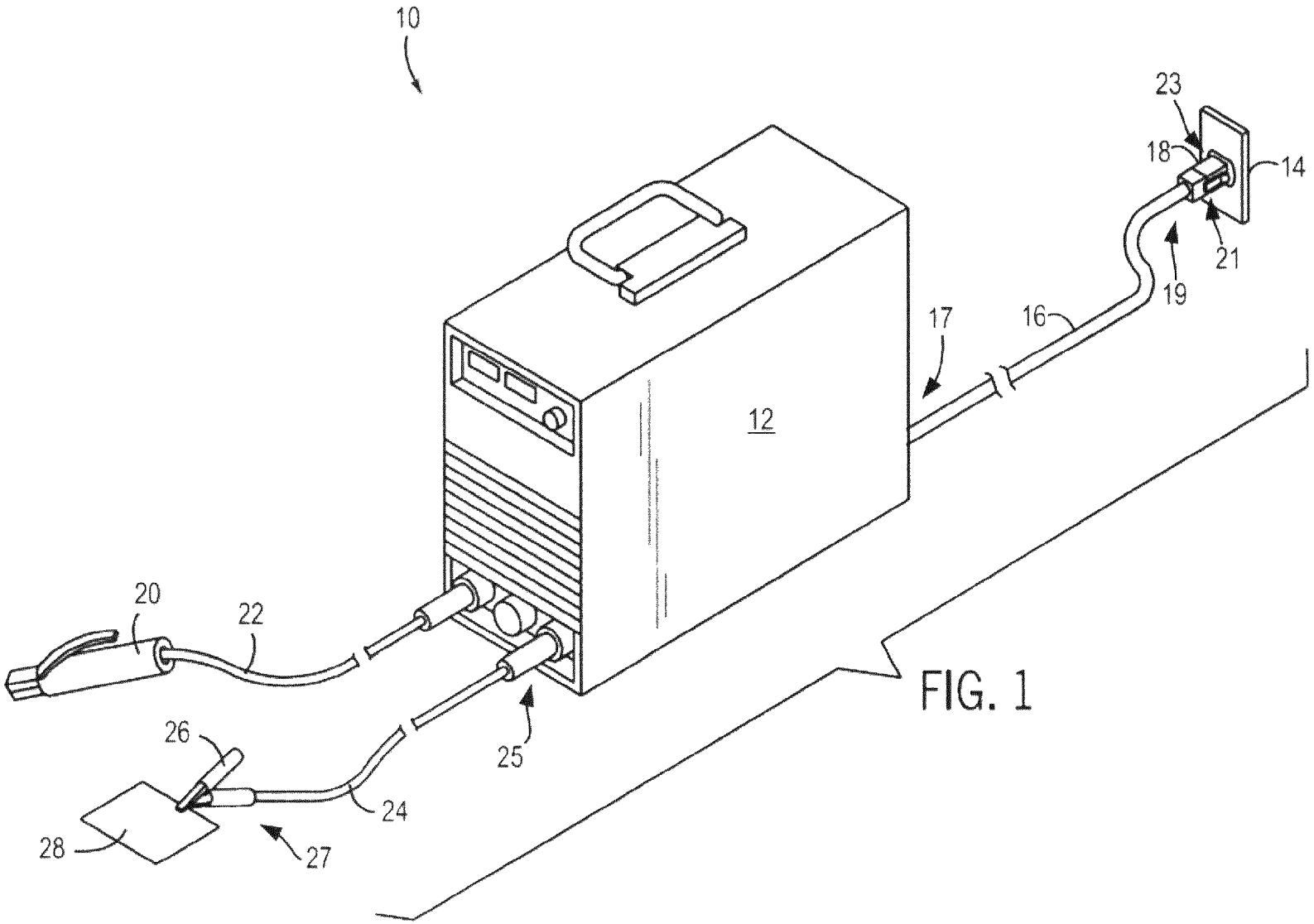
FIG. 1 is a perspective view of a welding-type system incorporating a power cord and adapter of the present invention.

Referring to FIG. 1, a welding system 10 includes a power source 12, constructed to generate an electrical signal suitable for welding-type applications. Power source 12 is configured to receive any one of a number of different input power signals. Some exemplary input power signal values include 110/115V, 200/208V, 230/240V, 380/415V, 460/480V, 500V, or 575V, which could be single-phase, three-phase, different current ratings, or frequencies such as 50 or 60 Hz signals. It is recognized that other power signals may be suitable or desirable. Regardless of the characteristics of the power signal, power source 12 is able to automatically detect the values of the input power signal and convert the signal into one suitable for welding-type applications. Alternatively, power source 12 may require a user to manually select a setting before receiving and converting a respective power input. In any event, power source 12 is supplied with an input power signal from an outlet 14 via a power cord 16 and an adapter 18.

Preferably, power cord 16 is removably attached at one end 17 to power source 12 and is electrically interconnected at another end 19 to adapter 18 and outlet 14. Alternatively, power cord 16 may be permanently attached to power source 12. Power cord 16 is configured to conduct a plurality of different power signals to power source 12. Adapter 18 has one end 21 electrically interconnected with power cord 16 at end 19 of power cord 16, and is electrically connected with outlet 14 at another end 23. As will be discussed further below, power cord 16 and adapter 18 allow for different power signals to be supplied from outlet 14. Outlet 14 is one of several having different electrical interface configurations that can supply an input signal to power source 12.

A torch 20 is operably connected to power source 12 via weld cable 22. Ground cable 24 is also attached to power source 12 at one end 25, and has a clamping member 26 attached at a second end 27. Clamping member 26 is constructed to removably secure cable 24 to workpiece 28 so that a desired welding application may be performed. Although the present invention will be described in terms of a welding application, one skilled in the art will appreciate that the present invention is equally applicable to other similar high power output operations, such as induction heating and plasma cutting.

Figures 2, 5A, 5B:
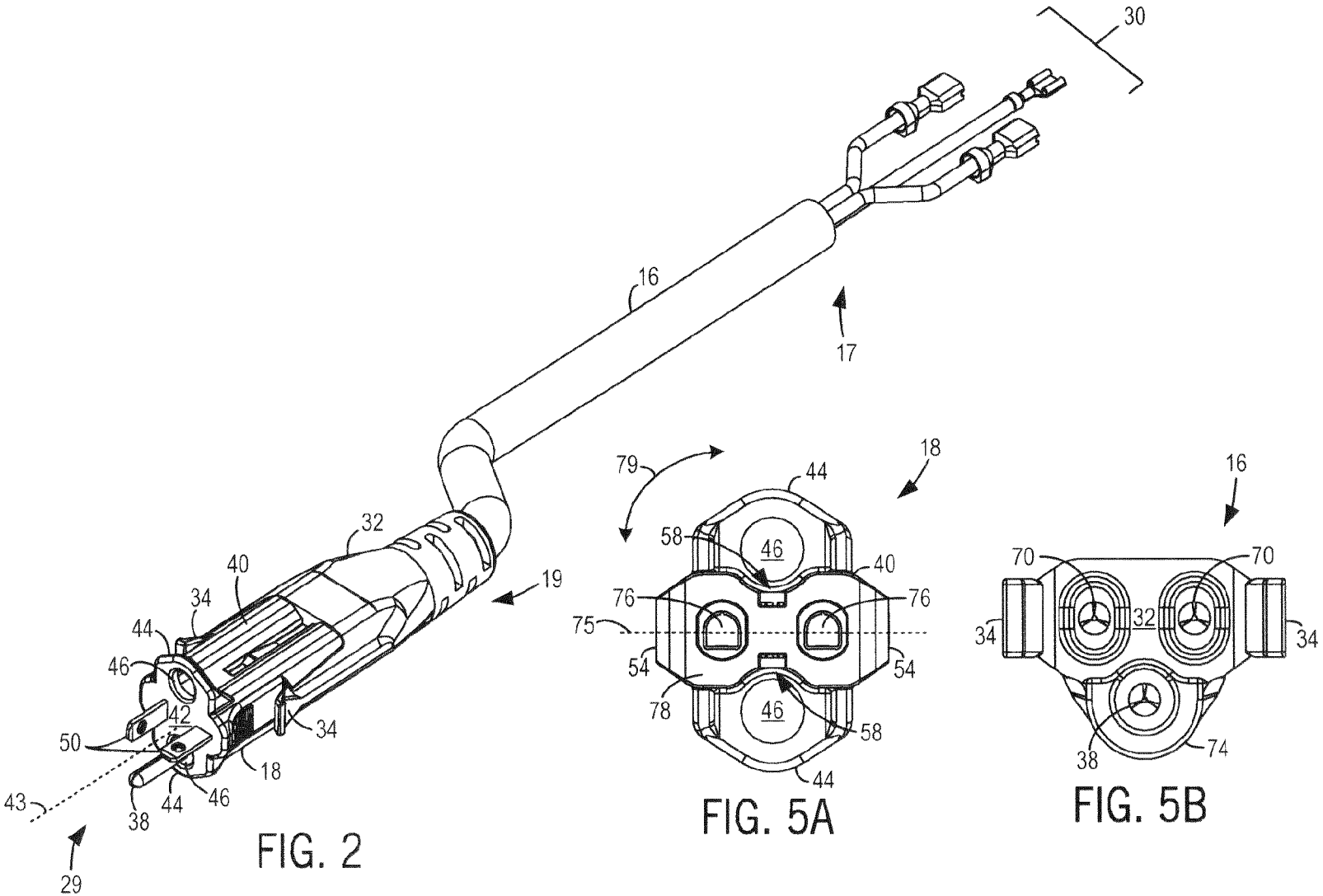
FIG. 2 is a perspective view of the power cord and adapter shown in FIG. 1.
FIG. 5A is an end view of the adapter taken along line 5A-5A of FIG. 4.
FIG. 5B is an end view of the power cord taken along line 5B-5B of FIG. 4.

Referring now to FIG. 2, power cord 16 is shown with adapter 18 connected in a first position 29 thereto. End 17 of power cord 16 is depicted having three electrical connectors 30. The electrical connectors 30 are constructed to engage the power source 12, FIG. 1, and electrically connect power cord 16 thereto. It is recognized that the shape, configuration, and number of connectors necessary to connect power cord 16 to the power source 12 may differ between various types of power sources. Alternatively, power cord 16 may be permanently attached to the power source such that a different configuration of electrical connectors is required.

Referring again to FIG. 2, power cord 16 has an adapter interface 32 at end 19 thereof. Adapter interface 32 is permanently affixed and integrally formed with power cord 16. Additionally, it is understood that adapter interface 32 may be formed of any suitable material or may be removable from power cord 16 so that other adapter interfaces could be attached thereto. Adapter interface 32 is formed having two snap lock arms 34 which extend from adapter interface 32 of power cord 16 to engage about adapter 18 when adapter 18 is attached thereto. It is understood that adapter interface 32 could be formed having more or fewer snap lock arms 34 thereon. A connector, or ground pin 38, of power cord 16 protrudes through adapter 18 such that ground pin 38 of power cord 16 electrically engages an inlet (not shown) of outlet 14, FIG. 1, when the power cord 16 is connected thereto.

Adapter 18, FIG. 2, is formed having an elongated body 40 and a plug or front face 42. It is recognized that other suitable variations in the appearance and shape of adapter 18 are possible, so long as adapter 18 is able to simultaneously interface with power cord 16 and an outlet, such as that shown in FIG. 1. The plane of front face 42, FIG. 2, is generally perpendicular to a longitudinal axis 43 of adapter body 40. Front face 42 includes two flanges, or tabs 44, that extend therefrom and are coplanar with front face 42. Tabs 44 extend in directions generally opposite one another and beyond adapter body 40. Each tab 44 has a hole, or opening 46, formed therein to allow ground pin 38 of power cord 16 to pass therethrough. Front face 42 also has two electrical prongs 50 which are preferably molded into front face 42. However, it is equally recognized that electrical prongs 50 may be otherwise fixedly secured to front face 42. Prongs 50 extend generally perpendicular to front face 42, are generally parallel to longitudinal axis 43 of adapter body 40, and are preferably not removable from adapter 18. Therefore, it can be seen that front face 42 is the surface of adapter 18 which can mate with electrical outlets. In this embodiment, prongs 50 are orientated 90 degrees apart, as will be further explained below.

Figure 3:
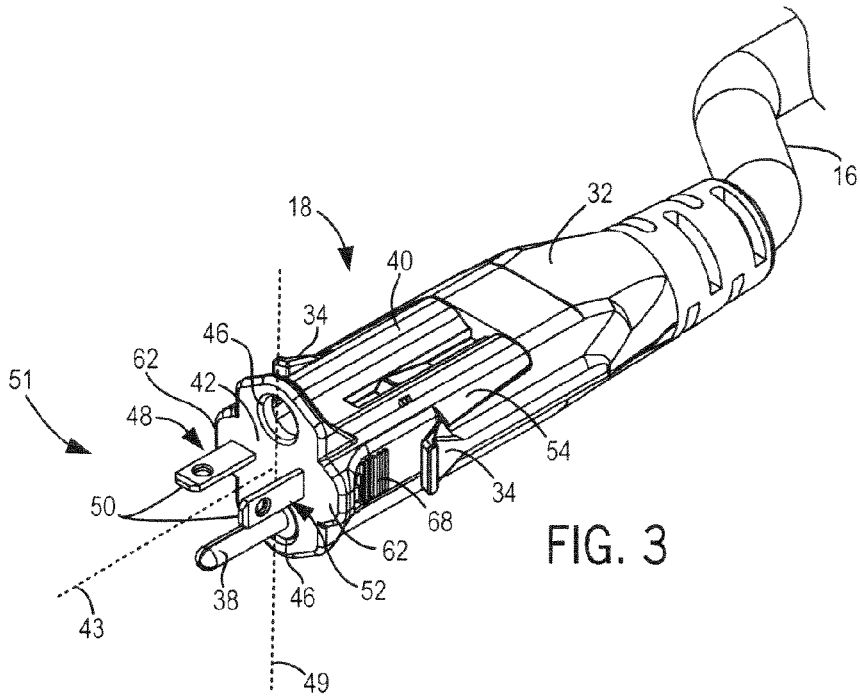
FIG. 3 is a perspective view of one end of the power cord with the adapter connected thereto in a first position.

Referring now to FIG. 3, adapter 18 is attached to power cord 16 in a second position 51, wherein adapter 18 is rotated 180 degrees from the first position shown in FIG. 2. Comparing FIG. 2 and FIG. 3, adapter 18 has been removed, rotated approximately 180 degrees about longitudinal axis 43 relative to cord 16, and reinserted and connected thereto in second position 51. Prongs 50 extending from front face 42 of adapter 18 are generally planar, rectangular metal protrusions common to many electrical prongs constructed to engage electrical outlets. Each prong 50 has an elongated planar side 48, 52. In one embodiment, the planes of the elongated sides 48, 52 of the two prongs 50 are perpendicular to one another, or in other words, one prong 50 with sides 48 is rotated 90 degrees with respect to the other prong 50 with sides 52. As such, the position of prongs 50 shown in FIG. 3 allows for engagement of power cord 16, with adapter 18 connected thereto, to a standard electrical interface configuration for a single-phase, 60 Hz, approximately 230V, 20 ampere line input voltage signal in the United States. Referring back to FIG. 2, when adapter 18 is positioned in first position 29, the power cord and adapter are configured to engage a standard electrical interface for receiving a single-phase, 60 Hz, approximately 115 volt, 20 ampere line input signal in the United States. Thus, it can be seen that when adapter 18 is rotated 180 degrees about a longitudinal axis of the body 40, the prongs 50 become oppositely oriented relative to power cord 16. Adapter 18 is therefore able to electrically interconnect with different outlet configurations.

Specifically, in FIG. 3, adapter 18 is shown in the second position 51 wherein the elongated side 48 of one prong 50 is horizontally oriented with respect to an axis 49 of front face 42 passing through openings 46, and the elongated side 52 of the other prong 50 is vertically oriented with respect to axis 49. Conversely, in FIG. 2, position 29 is shown wherein the prong 50 with elongated side 48 is vertically oriented and the prong 50 with elongated side 52 is horizontally oriented. However, adapter 18 is equally attachable to power cord 16 when prongs 50 are in either of the two aforementioned positions 29, 51.

Referring back to FIG. 3, body 40 of adapter 18 includes a pair of bosses 62 extending outwardly therefrom. Bosses 62 form gripping surfaces to allow an operator to quickly and conveniently engage or disengage adapter 18 from power cord 16. Bosses 62 include a plurality of ribs 68 which provide for improved gripping of the adapter 18 by an operator.

Also shown in FIG. 3, snap lock arms 34 secure adapter 18 to adapter interface 32 of power cord 16 when adapter 18 is orientated in second position 51, FIG. 3, or first position 29, FIG. 2. Referring back to FIG. 3, snap lock arms 34 engage ridges 54 formed on body 40 of adapter 18. When adapter 18 is thus secured to adapter interface 32 and power cord 16, any electrical contacts therebetween are kept generally free of dirt, moisture, or other contaminants and adapter 18 is substantially prevented from shifting or sliding with respect to adapter interface 32 of power cord 16. To release the adapter 18, snap lock arms 34 are deflected away from adapter body 40 so that adapter ridges 54 can slide past snap lock arms 34 and adapter 18 can disengage power cord 16.

Figure 4:
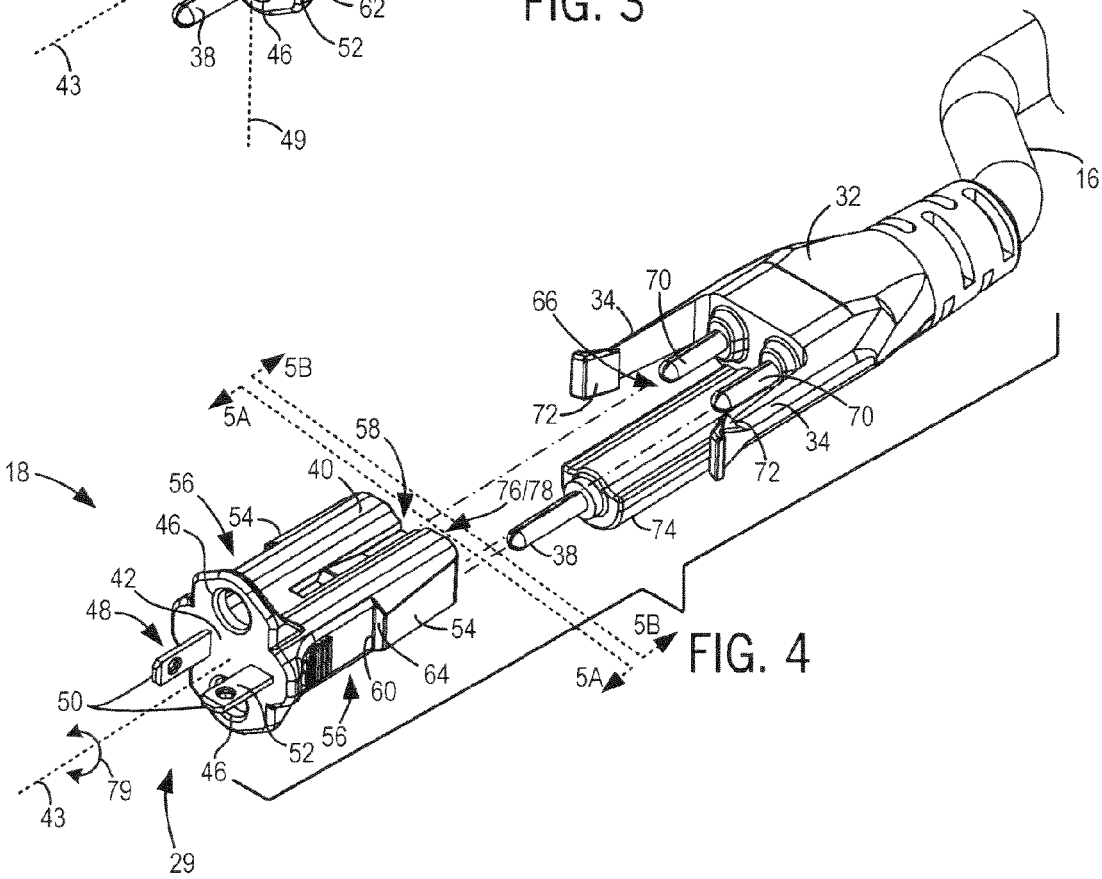
FIG. 4 is an exploded perspective view of one end of the power cord with the adapter removed therefrom and oriented in a second position relative thereto.

As shown in FIG. 4, adapter 18 is disengageable from power cord 16. Ridges 54 of adapter 18 are formed on lateral sides 56 of the adapter body 40. As shown, ridges 54 are generally triangular and protrude from adapter body 40 on opposing sides. Ridges 54 are tapered such that they gradually extend further outward from the adapter body 40 nearer the face 42 of adapter 18 to easily effectuate engagement upon insertion into adapter interface 32. At one end 60 of lateral sides 56 of adapter body 40, ridges 54 turn sharply back towards the body 40, forming shoulders 64 over which snap lock arms 34 engage. Snap lock arms 34 have inwardly pointing tabs 72 which snap fit over shoulders 64 of ridges 54 of adapter body 40.

Also shown in FIG. 4, power cord 16 has a pair of power contacts 70 and a ground pin 38 that extends from adapter interface 32 of power cord 16 past contacts 70. Ground pin 38 extends beyond the snap lock arms 34 so that it can protrude through a respective opening 46 of adapter 18 when adapter 18 is attached to power cord 16. Ground pin 38 extends from a ground pin collar 74, which is shown having a generally semi-circular cross section and is preferably an insulating jacket that extends past contacts 70. However, it is recognized that ground pin collar 74 may be of any shape suitable for interfacing with adapter 18 while allowing ground pin 38 to pass through one of the openings 46 of the adapter 18. Ground pin collar 74 slides into either of two complementary-shaped grooves 58, formed on opposing sides of adapter body 40, so that ground pin 38 can be positioned properly for interfacing with standard electrical outlet configurations. Additionally, groove 58 formed in adapter body 40 provides for greater stability of the engagement between adapter 18 and power cord 16 when ground pin collar 74 is positioned therein.

Prongs 50 of adapter 18 shown in FIG. 4 are arranged in first position 29, similar to that of FIG. 2 and opposite that of FIG. 3. Referring again to FIG. 4, adapter body 40 is formed such that a opening 46 is in position to allow ground pin 38 to protrude therethrough and a groove 58 is in position to fit about ground pin collar 74 when adapter body 40 is in either of first position 29, shown in FIG. 2, or second position 51, shown in FIG. 3. Furthermore, ridges 54 are engageable with snap lock arms 34 of power cord 16 in either of positions 29 and 51. Thus, adapter 18 interfaces a first outlet configuration and attaches to power cord 16 when positioned in first position 29 and interfaces with a different outlet configuration and attaches in a similar manner to power cord 16 when positioned in second position 51.

Still referring to FIG. 4, a slot 66 is formed between snap lock arms 34 into which adapter 18 slides when engaged with adapter interface 32. Electrical contacts 70 extend parallel to ground pin 38 from adapter interface 32 of power cord 16. Electrical contacts 70 electrically interface with receptacles or sockets 76 formed on a rear face 78 of adapter 18. A voltage signal is conducted from an outlet 14, FIG. 1, through adapter 18, FIG. 4, to contacts 70 when adapter 18 is engaged with an outlet. From contacts 70, a power signal passes through power cord 16 to a power source 12, FIG. 1. It is equally recognized that electrical contacts 70, FIG. 4, could be formed on the rear face 78 of adapter 18 and sockets 76 could be formed on adapter interface 32. Ground pin 38, however, passes through adapter 18, interfaces with an outlet, and connects power cord 16 directly thereto.

When an operator wants to connect a power source to a first outlet configuration, adapter 18 is slidingly engaged with adapter interface 32 of power cord 16. When the operator is required to connect the power source to a different outlet configuration, the operator, without the aid of tools, can simply and efficiently remove the adapter 18 from the adapter interface 32 of the power cord 16, rotate the adapter approximately 180 degrees as indicated by arrow 79, and reattach the adapter 18 to the adapter interface 32 of the power cord 16. As such, the operator can quickly and efficiently change the type of power signal the power source 12 is configured to receive.

Referring now to FIGS. 5A and 5B, FIG. 5A shows an end view of adapter 18 taken along line 5A-5A of FIG. 4, and FIG. 5B shows an end view of power cord 16 taken along line 5B-5B of FIG. 4. The rear face 78 of adapter 18 abuts adapter interface 32 of power cord 16 when adapter 18 is connected thereto. Whether adapter 18 is oriented as shown or rotated 180 degrees as indicated by arrow 79, receptacles or sockets 76 are configured to receive and electrically connect with electrical contacts 70. As shown in FIG. 5A, apertures, or openings 46, are formed in tabs 44 of the front face 42 of adapter 18, ridges 54 extend outwardly from adapter body 40, and grooves 58 are formed on opposing sides of adapter body 40 such that ground pin collar 74 may slide therein. It can be seen that the shape of adapter 18 and configuration of its constituent parts are substantially mirrored on both sides of a horizontal axis 75 drawn between sockets 76. Thus, adapter 18 attaches to power cord 16 with ground pin 38 extending through an opening 46 when adapter 18 is either oriented as shown or rotated 180 degrees as indicated by arrow 79. While the preferred embodiment shows openings 46 as holes, it is understood that such need not be completely enclosed. A partial enclosure, "U"-shaped configuration, or any opening to allow the ground pin 38 to pass will suffice.

As shown in FIG. 5B, electrical contacts 70 extend outwardly from adapter interface 32 of power cord 16 and are generally aligned with ground pin 38. Snap lock arms 34 extend from adapter interface 32 of power cord 16 on opposing sides of electrical contacts 70. When adapter 18 is attached thereto, electrical contacts 70 of power cord 16 are inserted into sockets 76, ground pin collar 74 is received in a groove 58 of adapter body 40, and snap lock arms 34 snap fit about ridges 54 formed on adapter body 40.

Thus, it can be seen that the present invention provides a power source the ability to easily connect to a number of different electrical interface configurations. A power supply system incorporating the present invention is desirable as requiring only a single adapter for connectivity with several outlet configurations. Additionally, due to the adapter 18 being snugly secured to adapter interface 32 of power cord 16 by snap lock arms 34, prongs 50 being fixedly attached to front face 42 of adapter 18, and ground pin 38 being securely formed in ground pin collar 74 of adapter interface 32 of power cord 16, the electrical power cord and adapter system disclosed herein forms a generally rugged and durable electrical connector.

Therefore, an adapter is provided which has an electrical outlet mating surface having a pair of electrical prongs extending outwardly therefrom, a body having a distal end and a proximate end, the body extending rearwardly from the electrical outlet mating surface and parallel to the electrical prongs, a pair of electrical sockets at the distal end of the body, each electrical socket in electrical communication with a respective electrical prong, and a pair of flanges extending outwardly from the electrical outlet mating surface, perpendicular to the electrical prongs, each flange having an opening therein sized to allow passage of an electrical grounding prong through each opening in each flange.

An adapter for a power cord of a welding-type power source is also disclosed and has a body having a first end and a second end, wherein the first end is electrically connectable to a power cord connectable to a welding-type device and the second end has a pair of prongs fixedly attached to the body and constructed to operably connect the power cord to a first outlet and a second outlet, the second outlet being configured differently than the first outlet.

An adapter is also provided for connecting a power cord to a plurality of outlet configurations. The adapter has a body having a plug and a receptacle. The receptacle is constructed to removably engage a power cord, and the plug is constructed to be connectable with a first electrical outlet configuration and a second electrical outlet configuration different than the first electrical outlet configuration. The body is constructed to allow a prong of the power cord to engage one of the first and second electrical outlet configurations with the body positioned therebetween.

The invention also includes a power cord for a welding-type device that includes a power cord having one end connectable to a power source of a welding-type device and another end connectable to an adapter. The adapter has a pair of immovable prongs, which are connectable to a first input voltage signal and a second input voltage signal wherein the first input voltage signal has a power characteristic different than a power characteristic of the first input voltage signal.

A welding-type apparatus is presented and has a power source configured to generate a welding-type power, a power cord having a first end connectable with the power source and a second end having an adapter interface and an electrical contact configured to engage electrical outlets, and an adapter configured to engage a number of different electrical outlet configurations.

A method is disclosed for providing a power cord and adapter useable with multiple electrical interface configurations. The method includes the steps of forming an adapter interface on a power cord having a pair of power prongs extending therefrom and a grounding prong extending significantly past the pair of power prongs, and molding an adapter to couple to the adapter interface of the power cord and having a pair of openings which allow the grounding prong to pass through one of the openings when the adapter is engaged with the power cord in one orientation and through another of the openings when in another orientation.

The present invention has been described in terms of the preferred embodiment, and it is recognized that equivalents, alternatives, and modifications, aside from those expressly stated, are possible and within the scope of the appending claims.

What is claimed is:

1. A power cord for a welding-type device, the power cord comprising:

one end connectable to a power source of a welding-type device and another end connectable to an adapter;

wherein the adapter has a pair of prongs molded into the adapter, the prongs connectable to a first input voltage signal and a second input voltage signal wherein the first input voltage signal has a power characteristic different than a power characteristic of the second input voltage signal; and wherein the adapter is removably attachable to the power cord in a plurality of positions.

2. The power cord of claim 1 wherein the adapter is connectable to both the power cord and different electrical outlet configurations at a first position, and a second position 180 degrees from the first position.

3. The power cord of claim 1 further comprising at least one snap connection arm to snugly engage a ledge formed on the adapter at a first orientation.

4. The power cord of claim 3 further comprising another snap connection arm to snuggly engage another ledge formed on the adapter, the another ledge engageable with the at least one snap connection arm and the another snap connection arm engageable with the ledge when the adapter is connected to the power cord at another orientation.

5. The power cord of claim 1 further comprising an elongated electrical contact which is operably engageable with an electrical outlet when the power cord is connected to the adapter.

6. The power cord of claim 5 wherein the elongated electrical contact engages an electrical outlet when the power cord is connected to the adapter in one of a first orientation and a second orientation.

7. A method of providing a power cord and adapter useable with multiple electrical interface configurations comprising the steps of forming an adapter interface on a power cord having a pair of power prongs extending therefrom and a grounding prong extending significantly past the pair of power prongs; and molding an adapter to couple to the adapter interface of the power cord and having a pair of openings which allow the grounding prong to pass through one of the openings when the adapter is engaged with the power cord in one orientation and through another of the openings when in another orientation.

8. The method of claim 7 further comprising the step of molding a pair of electrical contacts into a plug face of the adapter.

9. The method of claim 8 further comprising molding the pair of electrical contacts into the plug face of the adapter such that planar surfaces of one electrical contact are oriented perpendicularly with respect to planar surfaces of another electrical contact.

10. The method of claim 7 wherein the step of forming the adapter interface on the power cord includes forming a pair of snap lock arms to extend generally parallel to the grounding prong such that the pair of snap lock arms do not extend beyond the grounding prong.

11. The method of claim 10 further comprising forming a pair of shoulders on the adapter, each shoulder constructed to removably engage one of the pair of snap lock arms when the adapter is connected to the power cord in the one orientation and engage another of the pair of snap lock arms when the adapter is connected to the power cord in the another orientation.

12. The method of claim 7 further comprising connecting an end of the power cord generally opposite the end having the adapter interface to a welding-type device configurable to operate at more than one input power.

13. A power cord for a welding-type device, the power cord comprising:

a first power cord end connectable to a power source of a welding-type device and a second power cord end connectable to an adapter; and the adapter comprising:

a pair of prongs molded into the adapter, the prongs connectable to a first input voltage signal and a second input voltage signal wherein the first input voltage signal has a power characteristic different than a power characteristic of the second input voltage signal;

a pair of flanges; and an opening formed in each of the pair of flanges and constructed to allow passage of a conductor of the power cord therethrough to directly engage an electrical outlet.

14. The power cord of claim 13 wherein the adapter is removably attachable to the second power cord end in a plurality of positions.

15. The power cord of claim 13 wherein the adapter is connectable to both the second power cord end and different electrical outlet configurations at a first position, and a second position 180 degrees from the first position.

16. The power cord of claim 13 further comprising at least one snap connection arm to snugly engage a ledge formed on the adapter.

17. The power cord of claim 13 further comprising an elongated electrical contact which is operably engageable with an electrical outlet when the second power cord end is connected to the adapter.

18. The power cord of claim 17 wherein the elongated electrical contact is constructed to engage a ground connection of the first input voltage signal and a ground connection of the second input voltage signal.

19. The power cord of claim 13 wherein the power cord has at least one conductor more than a number of conductors of the adapter.

20. A power cord for a welding-type device, the power cord comprising:

one end connectable to a power source of a welding-type device and another end connectable to an adapter;

wherein the adapter has a pair of prongs molded into the adapter, the prongs connectable to a first input voltage signal and a second input voltage signal wherein the first input voltage signal has a power characteristic different than a power characteristic of the second input voltage signal; and wherein the adapter is connectable to both the power cord and different electrical outlet configurations at a first position, and a second position 180 degrees from the first position.

21. A power cord for a welding-type device, the power cord comprising:

one end connectable to a power source of a welding-type device and another end connectable to an adapter; and an elongated electrical contact which is operably engageable with an electrical outlet when the power cord is connected to the adapter;

wherein the adapter has a pair of prongs molded into the adapter, the prongs connectable to a first input voltage signal and a second input voltage signal wherein the first input voltage signal has a power characteristic different than a power characteristic of the second input voltage signal.

22. The power cord of claim 21 wherein the elongated electrical contact engages an electrical outlet when the power cord is connected to the adapter in one of a first orientation and a second orientation.

* * * * *